United States Patent [19]

Caulier et al.

[11] Patent Number: 4,867,583

[45] Date of Patent: Sep. 19, 1989

[54] DOT MATRIX PRINTER/MODULE USING PRINT WIRES HAVING DIFFERENT LENTH BUT EQUAL MASS

[75] Inventors: Paul W. Caulier, Greenwood; Leon C. Johenning, II, Lexington, both of Va.

[73] Assignee: Genicom Corporation, Waynesboro, Va.

[21] Appl. No.: 581,899

[22] Filed: Feb. 21, 1984

Related U.S. Application Data

[63] Continuation-in-part of Ser. No. 450,020, Dec. 15, 1982, abandoned.

[51] Int. Cl.[4] ..... B41J 1/12

[52] U.S. Cl. ..... 400/124; 101/93.05

[58] Field of Search ..... 400/124, 157.3, 166; 101/93.05, 93.02, 93.03, 93.31, 93.32; 420/494

[56] References Cited

U.S. PATENT DOCUMENTS

| | | | |
|---|---|---|---|
| 3,376,171 | 4/1968 | Verdoak | 420/494 |
| 3,876,050 | 4/1975 | Linder | 101/93.05 |
| 3,896,918 | 7/1975 | Schneider | 400/124 |
| 3,904,011 | 9/1975 | Matschke et al. | 400/124 |
| 3,994,381 | 11/1976 | Hebert | 400/124 |
| 4,004,673 | 1/1977 | Burzlaff et al. | 400/124 |
| 4,098,388 | 7/1978 | Dubois | 400/124 |
| 4,143,979 | 3/1979 | Boyd | 400/124 |
| 4,279,518 | 7/1981 | Blomquist | 400/124 |
| 4,306,497 | 12/1981 | Hamada | 400/124 |

FOREIGN PATENT DOCUMENTS

| | | | |
|---|---|---|---|
| 2805695 | 8/1978 | Fed. Rep. of Germany | 400/124 |
| 56-117667 | 9/1981 | Japan | 400/124 |
| 57-142371 | 9/1982 | Japan | 400/124 |
| 57-187270 | 11/1982 | Japan | 400/124 |

OTHER PUBLICATIONS

"Matrix Print Head Wire Length Adjustment Technique"; R. H. Harris; *IBM Technical Disclosure Bulletin;* vol. 26, No. 2, p. 794–S; Jul. 1983; 400/124.

*Primary Examiner*—David A. Wiecking
*Attorney, Agent, or Firm*—Nixon & Vanderhye

[57] ABSTRACT

A dot matrix shuttle printer and/or a module therefore uses print wires of different lengths so as to achieve desired close packing of individual print wire actuators and correspondingly close wire-to-wire spacing of the print wires. To help maintain synchronization between the operation of all print wires, the longer ones include hollow sections so as to cause all the print wires to have substantially equal mass in spite of their differing lengths. The longer print wires include a hollow tube of stainless steel. A tip of wear resistant material is fixedly inserted at one end of the tube to effect impact printing.

13 Claims, 3 Drawing Sheets

FIG. 5
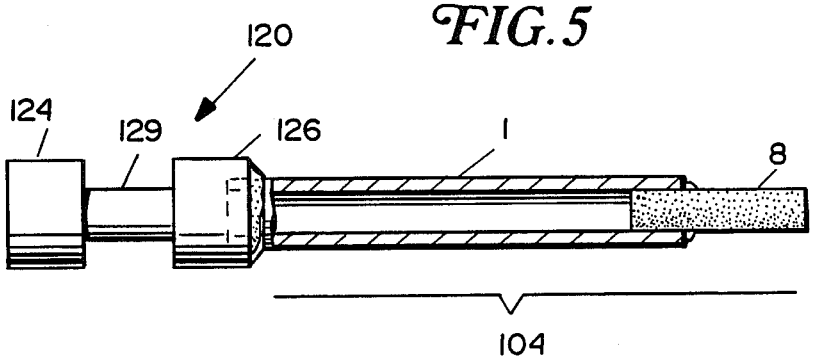
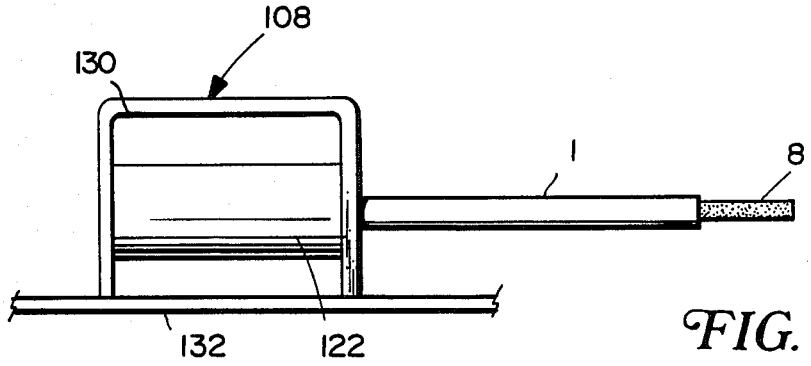
FIG. 6A
FIG. 6B
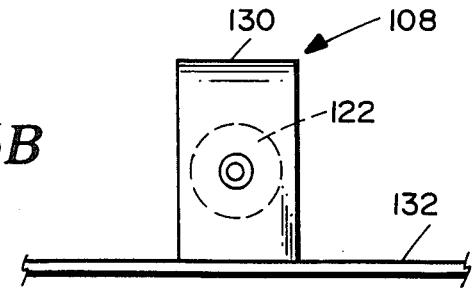

DOT MATRIX PRINTER/MODULE USING PRINT WIRES HAVING DIFFERENT LENTH BUT EQUAL MASS

This application is a continuation-in-part of our earlier copending commonly assigned application Ser. No. 450,020 filed Dec. 15, 1982 and now abandoned. It is also related to a commonly assigned application Ser. No. 440,811 filed Nov. 12, 1982 and issued on Aug. 28, 1984 as U.S. Pat. No. 4,468,142 entitled PRINT WIRE ACTUATOR.

This invention relates to dot matrix printers and particularly to the print wires and to modules of same used to effect printing in a dot pattern. It is particularly related to dot matrix printers of the so-called "shuttle" type wherein one or more print wires are periodically shuttled back and forth across the desired print area(s).

The term dot or matrix printing used herein refers to a printing system wherein characters or symbols are composed and typed by a set of small points, that is dots, formed on a record medium by causing selected wires from among several fine wires to strike the paper with proper timing through an inking material such as inked or carbon ribbon. Dot printing requires no provision of a large number of types in advance. In practice, a relatively small number of wires are generally needed in dot printing in order to type the symbols. Because of its simplicity, dot printing has been widely used in recent years.

According to one typical type of printer, a column of several wires are moved across a very short distance several times in a direction perpendicular to the column and only the required wires corresponding to a character to be typed are struck in each of the several row positions, thereby to form dots in the pattern of that character, one desired character being typed by a selected combination of these dots. Similarly, other characters are typed in turn by displacement of the entire bundle or column of wires to the next symbol column position.

Another type of dot matrix printer now coming into increasing popularity is the so-called "shuttle" type. Here a linear array of spaced-apart print wires is repetitively "shuttled" back and forth in a horizontal plane with the peak-to-peak amplitude of shuttling movement at least equalling the spacing between print wires. In this way printed dots may be selectively placed at any desired position along a horizontal line. Controlled relative vertical movement between the shuttling print wire array and the medium to be printed then permits dots to be accurately placed as desired in two dimensions for the creation of any desired print pattern(s).

To achieve desired higher printing speeds in a shuttle type dot matrix printer (e.g. 600 lines per minutes), it is desirable to keep the spacing between print wires small (e.g. 0.2 inch) so as to keep the required peak shuttle velocity correspondingly small for the necessarily higher shuttle frequency needed to service the more rapid vertical paper movements. However, the individual print wire electromagnetic actuators must be of certain minimum outside diameter (e.g. 0.38 inch) larger than the desired inter-wire spacing so as to retain necessary wire driving abilities (e.g. applied impact forces, rapidity of movement, etc.). Since the print wires for a shuttle printer are preferably arranged in a linear array, this adverse difference between desired maximum print wire spacing and minimum actuator size presents a dilemma.

In some prior art shuttle type printers, alternating ones of the actuators have been separated into different arrays which, through mechanical linkage (e.g. leveraged clappers), are coupled to strike and drive corresponding ones of the more closely spaced single linear array of print wires. However, such mechanical linkage is considered inferior to a more direct driving arrangement such as that described in the related commonly assigned application Ser. No. 440,811 filed Nov. 12, 1982. On the other hand, if these "direct drive" actuators are arranged in a staggered linear array so as to accommodate the desired closer print wire spacing, then alternating ones of the print wires are necessarily longer than others and this also may lead to undesirable problems in maintaining common synchronization between the operations of all print wires—both long and short. And, if the print wires/actuators are split into plural offset horizontal arrays vertically spaced from one another, then this too may lead to control problems.

In order to form a dot, the print wire should be fine. In general, the wire has a diameter of about 0.011 to 0.016 inch and the length of as much as about 10 centmeters. The wire is struck at high speed and pressures and sometimes is used in a curved or bent state in some positions. Oftentimes prior art wires have been found to break during use in a relatively short time. Also, the working tip or point of the wire, that is the impacting point with which a record medium, such as paper, is contacted, has been found to wear rapidly, thereby adversely affecting the quality of printing.

A wide variety of proposals have been made to overcome these disadvantages. However, none have been entirely satisfactory.

The complexity of the various prior art approaches utilized has been a major source of cost and it has also contributed to the difficulty of maintenance and repair for such designs. For example, in order to overcome the relatively high frictional and impact forces which are imposed on the small diameter printing wires, recourse has been made to relatively hard and brittle impact materials in some of the designs. The printing forces which may be on the order of one or two pounds for a six copy, five carbon printing task, requires good print wire wear and impact resistance qualities. Tungsten or tungsten carbide wires have been utilized in the past because of the high hardness and good impact resistance and wear qualities of these materials. Also, high carbon steel music wire and other tough, flexible and hard metal wire impactors or needles, as they are sometimes called, have been used. Unfortunately, using the hard brittle and expensive materials has made the assembly operation more expensive due to breakage of the wires which cannot successfully stand a high degree of flexure or bending either in the assembly operation or in use. Furthermore, because of the abrasive qualities of such materials due to their surface finish, a good deal of effort has been put forth in providing jewel guides, low flexure guides, filled polymer guides, straight line approximations in the wire guides and other similar innovations. Music wire tends to corrode under the influence of ink and other fluids. Attempts to provide corrosion resistance coatings to the music wire offers numerous disatvantages. With the trend to higher speed printing, these problems become more acute.

Furthermore, print wire mass becomes important at the higher speeds of operation. Higher speed printing requires higher acceleration. Since acceleration is equal to drive force divided by mass, a lower mass for a given drive force will permit higher velocities. Actuators such as described in U.S. Pat. No. 4,098,388 use tungsten carbide wires which have excellent wear characteristics, but unfortunately they have large mass. Grinding of the tip is difficult and costly. Even where a wear resistant tip is provided on a solid core print wire as described in U.S. Pat. No. 4,155,660, there is still the problem of relatively large mass. Thus, despite these efforts, there still exists a need to simplify assembly, reduce breakage and increase the life of the print wire and hence the print head.

There also remains a need to provide a better print wire/actuator module for use in a shuttle printer.

Prior art cited by the Examiner in parent .application Ser. No. 450,020 is listed below:

U.S. Pat. No. 4,098,388—Dubois (1978)
U.S. Pat. No. 4,143,979—Boyd (1979)
U.S. Pat. No. 4,176,975—DeBoskey et al (1979)
U.S. Pat. No. 4,304,495—Wada et al (1981)
U.S. Pat. No. 4,307,966—Spencer et al (1981)
Japanese Pat. No. 142,371—Kamata (1982)
Japanese Pat. No. 000,174—Nose (1981)
Japanese Pat. No. 012,851—Nippon (1980)
Japanese Pat. No. 84,869—Asano (1982)
Belvin et al, "Wire Matrix Print Head", IBM Tech. Disclosure Bulletin, Vol. 20, #7, Dec. 1977, pages 2787–2788.

These prior art documents do show various composite constructions for print wires. Belvin, Kamata and Nose even show various concentric structures including hollow steel tubes with tungsten carbide printing tips. However none of the references offer any suggestion for solving the shuttle printer dilemma discussed above.

In view of the foregoing difficulties and problems inherent in the technology of printing wires and shuttle print modules according to the various designs outlined above, efforts continue in order to find inexpensive and satisfactory mutual solutions to many of the foregoing problems.

Now, however, we have discovered a novel direct drive dot matrix shuttle printing module having desired close inter-wire spacing utilizing print wires of differing lengths but still maintaining substantially equal print wire masses so as to alleviate synchronization problems. This is achieved, in part, by using partially hollow print wire structures for the longer print wires in the module.

Thus, it is an object of this invention to provide an improved dot matrix printer and/or printing wire module.

Briefly, in accordance with one exemplary embodiment of the present invention, the longer printing wires used in a print wire module of a shuttle-type matrix printer comprise a hollow tube of stainless steel having a predetermined length. A wear resistance tip of tungsten carbide is fixedly inserted at one end of said tube for impacting a print medium to effect printing on the medium upon actuation of the printing wire. The relative lengths of hollow and solid parts in these longer print wires is chosen to be equal in mass to the mass of all other print wires including those of substantially shorter length.

In other types of applications where the hollow print wire is to be indirectly driven through mechanical linkage, a cap of wear and impact resistant plastic material may be formed, as for example by molding, onto a tapered preform of beryllium copper swaged onto the end of the tube. The preform in this case, may be dimensioned to provide an enlarged supporting surface for the cap to receive and transmit actuation forces to the tube and hence the tip to cause the tip to impact said print medium and effect printing.

The invention consists of certain novel features and a combination of parts hereinafter fully described, illustrated in the accompanying drawings, and particularly pointed out in the appended claims, it being understood that various changes in the details may be made without departing from the spirit, or sacrificing the advantages of the present invention.

For the purpose of facilitating an understanding of the invention there is illustrated in the accompanying drawings preferred embodiments thereof from an inspection of which when considered in connection with the following description, the invention, its construction and operation and many of its advantages should be readily understood and appreciated.

Referring to FIG. 1, there is shown in cross-section one embodiment of a stainless steel hollow tube useful in effecting printing at high speeds and involving a low mass.

FIG. 5 is a side view of a directly driven, partially hollow print wire of the type employed in the presently preferred exemplary embodiment of this invention and also generally illustrated in FIG. 3 together with the double piston driven member of an electromagnetic actuator.

FIGS. 6A and 6B are side and end views respectively of an assembly of a direct drive electromagnetic actuator and the partially hollow print wire of FIG. 5.

Figure 1:
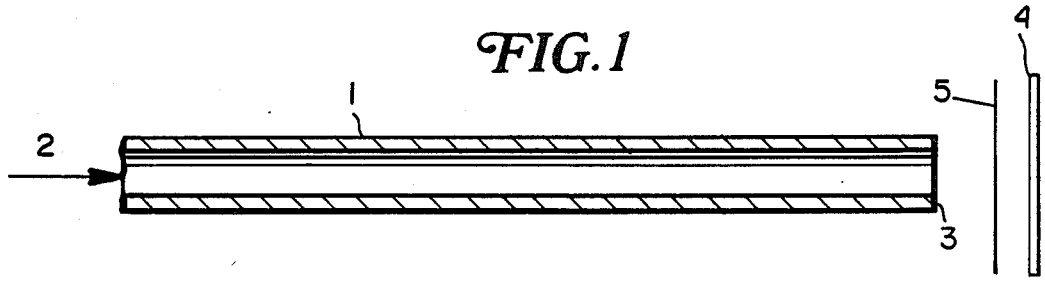

Referring to FIG. 1, there is shown a print wire of low mass comprising a hollow tube 1 made of rust resistant material such as stainless steel. Only the impact end of the print wire is shown in FIG. 1. Printing is effected by imparting actuating forces, such as for example by a clapper solenoid, in the direction 2 to cause the tip 3 to impact a print medium such as paper 4 through an inked or carbon ribbon 5 placed in the path between the tip 3 and the paper 4. As previously mentioned, a low mass permits higher speed operation due to the fact that the accelerating forces required to achieve the higher speeds can be substantially reduced. In one embodiment, the use of a stainless steel tube with 0.014 outside diameter and a 0.009 inside diameter resulted in a weight reduction of the order of one half that of a solid print wire, for example formed of music wire.

Figure 2:
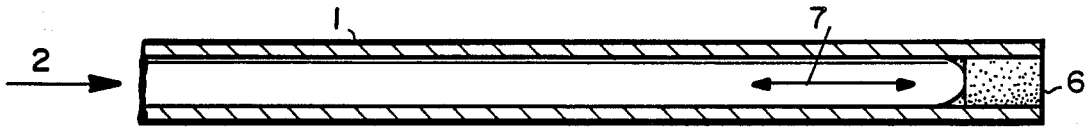
FIG. 2 illustrates a wear tip provided in the arrangement of FIG. 1 without the necessity of reshaping the wear tip after adhesive bonding or brazing to the tube.

FIG. 2 illustrates a further embodiment in which a wear tip 6 is provided in the form of an insert of a wear resistant material such as tungsten carbide. The insert 6 is placed at the impact end of the hollow tube and either brazed or cemented in place. To accommodate different mass requirements or limitations, the length of the wear resistant material insert can be increased along the length of the tube as shown by the arrow 7. After the wear resistant tip has been inserted, the end of the hollow tube with the tip can be ground smooth for the purpose of providing neat dot printing.

Figure 3:
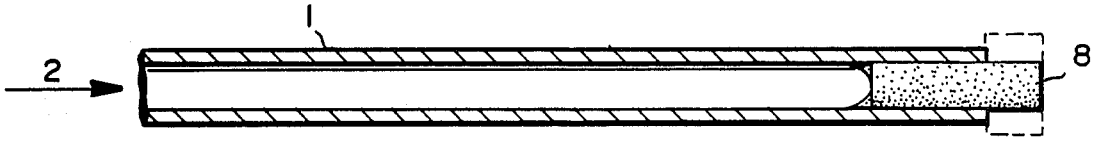
FIG. 3 illustrates in cross-sectional form a presently preferred exemplary embodiment in which the wear tip is provided with one end inserted and brazed into the hollow tube and a portion protruding for printing purposes.

FIG. 3 is a further embodiment of the invention which avoids the necessity of shaping the wear tip 8 in three dimensions in the case where a blob of wear resistant material is brazed to the tip of a solid wire, such as music wire. Here the tip, with its printing end already shaped, is inserted at the one end of the hollow tube and brazed in place with a portion 8 of the tip protruding from the tube 1. After the tube 1 and tip 6 have been assembled, the end of tip 6 is ground to the desired length to effect proper printing. It should be noted that in the arrangement of the present invention, the only grinding required is that to establish the length of the insert at the end where the impact printing is to take place.

In the arrangement of FIG. 2, the ability to vary the mass of the insert provides control over the mass of the overall printing wire which may be desirable to make adjustments toward modifying the speed or quality of printing, or for example, the number of copies to be printed. Also, the diameter of the wear tip 8 may be varied to adjust the impact pressure to a desired value for a given impact force. This feature is shown by the enlargement of the diameter of the wear tip 8 protruding from the hollow tube stylus in dotted lines in FIG. 3. This provides a reduced impact pressure for a given impact force. The wear tip 8 may also be reduced to increase the impact pressure for a given impact force.

It should be noted that the arrangements of FIGS. 1 through 3, by using a stainless steel tube, avoids the problems associated with printing wires, such as music wire, which tend to rust in high moisture atmosphere or in response to the migration of ink around the wires. The resulting rusting interferes with the proper operation of the print wires, because they have to pass through bearing surfaces, and produces a deterioration and destruction of such bearing surfaces. The corrosion also leads to nonuniform printing due to sticking of the print wires during actuation because of changing friction forces.

Thus, we have described a low mass printing wire which provides the desirable feature of having a non-rusting surface that is smooth and offers low friction during print wire actuation, whose mass can be varied to suit different applications while providing good printing action with a long print tip.

In the embodiment of FIG. 3, the wear tip 8 is of smaller diameter than the tube diameter thereby affording fine printing where this is desirable. The tube of smooth stainless steel provides a sheath of low resistance to very close diameter tolerances, thus avoiding the problems associated with applying a coating, as for example electroless nickel plating. Such a coating is usually rough, provides poor dimensional control and has only marginal corrosion resistance.

Figure 4:
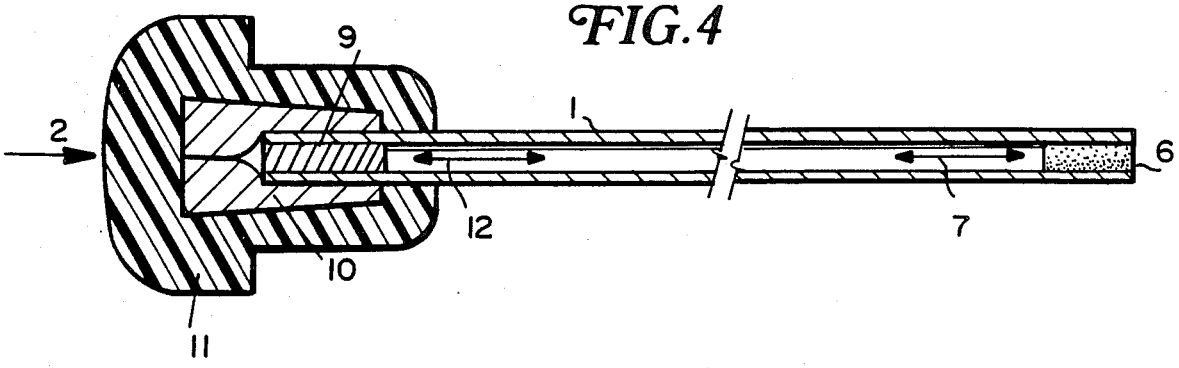
FIG. 4 illustrates in cross-sectional form an arrangement involving a hollow tube with a wear tip included at one end and an insert included at the other end over which there is swaged a preform. The preform is then provided with a cap to facilitate the imparting of drive forces from an external source such as an actuator to the tube and hence the tip to effect printing.

In order to drive the printing wire indirectly through mechanical linkage, a cap is oftentimes provided at the end of the print wire opposite the printing tip. In the past, this has been provided by brazing or molding a cap onto the solid print wire. The present invention offers the advantage of using the hollow tube to receive the cap in a novel manner. In the embodiment shown in FIG. 4, a preform 10 of dimensionally stable material such as beryllium copper, is inserted over the hollow tube bearing a metal insert 9 and swaged over the hollow tube 1 so that a strong attachment occurs between the beryllium copper and the hollow tube. In the instance where the driving mechanism for the print wire is, for example, a clapper solenoid arrangement, the repeated stroking of the beryllium copper preform 10 by the clapper of the solenoid driver would cause the preform to wear. In this instance, applicants have found that by molding an impact resistant plastic material such as a filled nylon, the nylon serves as a matrix for the dimensionally stable filler material which would also be a wear resistant material. Thus, the advantage of the hollow tube is retained, enabling high speed print wire actuation with low mass while still providing noncorrosive printing wire with a highly wear resistant tip and an impact resistant cap for effecting printing.

In addition to enabling the length of the tip 6 to be varied in the tube 1 as shown by arrow 7, the present invention permits the length of the insert 9 to also be varied as shown by arrow 12. These features afford opportunities to customize the printing characteristics desired from a print head.

Figure 7A:
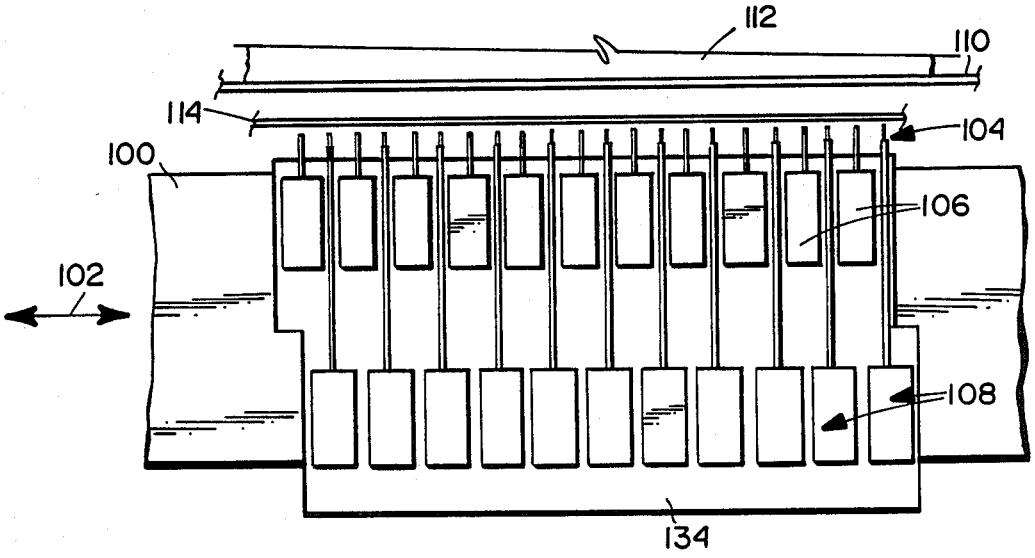
FIGS. 7A and 7B are top and end views respectively of a presently preferred exemplary embodiment of a dot matrix shuttle printing module in accordance with this invention wherein alternate ones of the actuator/print-wire assemblies use relatively longer partially hollow print wires as shown in FIGS. 5, 6A and 6B.
Figure 7B:
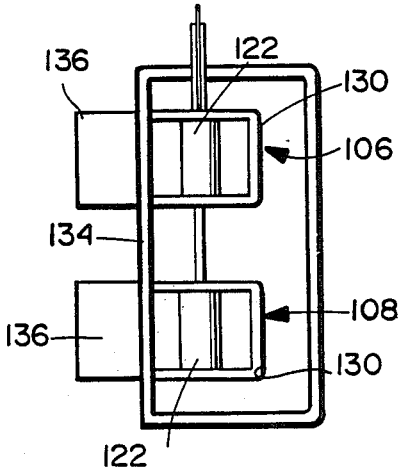

The presently preferred exemplary embodiment of a dot matrix shuttle printing module and its various components is depicted by FIGS. 5, 6A, 6B, 7A and 7B. The overall modular assembly is shown at FIGS. 7A and 7B. As previously mentioned, a shuttle carriage 100 is oscillated in a horizontal plane by means indicated by the double-headed arrow 102. A linear array of print wire tips 104 is in this manner caused to shuttle back and forth by a peak-to-peak displacement approximately equal to the spacing between individual print wires in the linear array 104.

Each of the print wires is directly driven by an electromagnetic actuator. As shown in FIG. 7A, the electromagnetic actuators are divided into two sets 106, 108 and horizontally staggered with respect to one another so as to permit relatively close inter-element spacing in the print wire array 104. As also can be seen from FIG. 7A, this necessitates substantial length differences between adjacent print wires. In particular, this effectively divides the print wires into two alternating wire subsets with one subset having substantially longer print wires than the other.

As will be appreciated, when any of the electromagnetic actuators 106, 108 is fired, its respective print wire is driven outwardly to strike a paper or other print media 110 (typically backed by a platen or the like 112). An intermediate inked or carbon ribbon or the like 114 is typically employed so as to cause the transfer of a dot printed element on the medium 110. The print wires are typically guided by conventional guides (not shown) so as to constrain their movements except along a horizontal print wire axis. As previously mentioned and as well understood in the art, the placement of a dot at any desired position the paper can be achieved by properly controlling the desired actuators in timed synchronism with the horizontal movement of the shuttle carriage 100 and the vertical movement of the paper or other print medium 110.

The electromagnetic actuators 106, 108 are, in the preferred exemplary embodiment, all substantially identical in construction and are described in more detail in the related copending commonly assigned application Ser. No. 440,811 filed Nov. 12, 1982. Briefly, as depicted in FIGS. 5, 6A and 6B, the actuator assembly includes a direct drive dual piston assembly 120 received within a cylindrical guide of an electromagnetic coil assembly 122. The dual piston assembly 120 includes a pair of pistons 124, 126 rigidly interconnected by a reduced diameter portion 128. A print wire 104 is directly brazed into a recess at one end of one of the pistons as depicted in FIG. 5. Thus the rear end of each print wire 104 is supported and directly driven by the double piston driver of its actuator. In addition to the electromagnetic coil and cylindrical guide structure 122, the actuators 106, 108 also include a magnetic return path structure 130 mounted on a magnetic base plate 132.

For added convenience in manufacturing and servicing, the actuators are preferably grouped into modules as shown in FIG. 7A. In the presently preferred exemplary embodiment, the modules are used in a line printer having a total of 66 actuators/print wires grouped into three modules of 22 actuators/print wires each. When mounted contiguously together on the shuttle carriage 100, a continuous linear array of 66 print wires 104 is provided. Each module includes a base plate 134 on which the individual actuators are mounted (the base plate may also constitute the magnetic circuit base 132 and may include depending heat dissipating fins 136 as shown in FIG. 7B).

It will be appreciated that the double piston assembly 120 is made of a magnetically permeable material such as low carbon iron or the like. In the present exemplary embodiment, the piston assembly 120 is machined although it may be formed by other conventional techniques as well.

As previously mentioned, in a dot matrix shuttle printer, the linear array of print wires 104 is shuttled laterally with an approximately sinusoidal motion having a peak-to-peak amplitude of displacement equivalent to the spacing between adjacent actuator/print wire assemblies. As will be appreciated by those in the art, if one is to accommodate higher printing speeds (e.g. higher rate of vertical paper motion resulting in larger numbers of printed lines per minute), the shuttle carriage 100 must be shuttled at relatively higher frequencies so as to ensure the possibility of placing a printed dot at any desired place on medium 110. However, the maximum permissible shuttle velocity is effectively limited by the rapidity with which any given print wire can be successively actuated. That is, if the shuttle velocity should become too high, then it may no longer be possible to place printed dots as close together as desired since there is a maximum print wire actuation frequency for any given actuator/print wire construction.

The limitation upon print wire actuation frequency thus effectively limits the maximum shuttle velocity. This, in turn, effectively limits the maximum or peak-to-peak shuttle displacement because the sinusoidal shuttle velocity is the time derivative of the sinusoidal shuttle displacement and such time derivative is necessarily directly proportional to the frequency of shuttle displacement.

By this chain of consequences, it has been found desirable for higher speed shuttle printers to maintain an interelement spacing between the print wires less than the minimum outside dimensions of the actuator mechanism. So as to achieve the necessary somewhat closer spacing of the print wires, two staggered arrays of actuators 106, 108 are preferably employed to drive a single linear array 104 of print wires as depicted in FIG. 7A. However, this arrangement necessarily causes alternate ones of the print wires to be considerably longer than the neighboring print wire.

If both the long and short print wires are of similar construction and materials, this will cause the longer print wires to have a significantly greater mass than the shorter print wires. Since the mass of the print wire is a significant factor in determining the printed dot response resulting from activation of a given print wire actuator, this difference in mass presents significant potential control problems dependent upon whether a long or short print wire is to be activated.

These control problems have been avoided in this invention by maintaining substantially constant mass print wires irrespective of the print wire length. This control over the print wire mass is achieved, in the exemplary embodiment, by employing at least partially hollow print wires (e.g. of the type generally depicted at FIG. 3) for the longer ones of the print wires in the module of FIG. 7A.

A more detailed explanation of the underlying technical considerations involved in the exemplary embodiment will now be given. At the outset, it should be remembered that the maximum peak-to-peak shuttle velocity is essentially fixed at some predetermined value by the actuator parameters such as wire stroke, maximum stylus frequency, etc., and the desired print parameters (e.g. the desired dot-to-dot spacing and the like). Under these circumstances, the shuttle motion is described by the following expressions:

$$X = X_o \sin(wt) \qquad \text{[Equation 1]}$$

and $$V = X_o\, w \cos(wt) \qquad \text{[Equation 2]}$$

with $X$ = instantaneous displacement $X_o$ = peak displacement $V$ = instantaneous velocity of the shuttle $w = 2\pi f$ $f$ = shuttle frequency $V_o$ = peak velocity peak values are then $$V_o = X_o\, 2\pi f \qquad \text{[Equation 3]}$$

or $$X_o = \frac{V_o}{2\pi}\ \frac{1}{f} \qquad \text{[Equation 4]}$$

with $(V_o/2\pi)$ being constant.

The peak-to-peak amplitude of the shuttle or the actuator spacing is then $2X_o$.

A minimum actuator width (e.g. 0.38 inch) can be achieved in an attempt to match the actuators to the spacing requirements of a high speed (e.g. 600 lpm) printer. Such a machine, however, may require a closer stylus spacing (e.g. 0.2 inch). Further attempts to reduce the actuator width may result in an unacceptable deterioration of actuator performance.

A possible multi-level arrangement of actuators (e.g. two vertically spaced linear arrays of print wires) poses a considerable synchronization problem between the printing of a first row of actuators and printing of a second row which occurs at a different time. Both rows would contribute parts of the same print pattern. Staggering of actuators as in FIG. 7A permits use of the desirably wider actuator units and while still achieving the desired closer print wire spacing.

However, if all print wires are of common construction, the difference in print wire (stylus) lengths causes a difference in actuator mass (e.g. perhaps about 20% more for the long wire) which is noticeable since solid stylii may consist of tungsten wire which is quite heavy. Such a difference in mass is undesirable since it causes differences in the dynamic characteristics of the print actuators as will now be demonstrated.

Assuming constant acceleration a during an input drive pulse of width $t_p$ (producing a drive force $F_D$ for a time $t_p$) applied to an actuator of mass m, one can write:

$$a = \frac{F_D}{m} \qquad \text{[Equation 5]}$$

The distance x travelled during acceleration for a time $t_p$ is then:

$$\text{then: } x = \frac{a}{2} t_p^2 = \frac{F_D}{2m} t_p^2 \qquad \text{[Equation 6]}$$

Thus, any increase in print wire mass decreases the distance travelled by the wire during acceleration.

Taking the time derivative gives the print wire velocity $V_F$ at the end of the acceleration time:

$$V_F = \frac{F_D}{m} t_p \qquad \text{[Equation 7]}$$

Thus, an increase in mass reduces the final velocity of the wire with which it coasts until it hits the print medium (e.g. paper). Assuming a constant velocity $V_F$ for the coasting phase of the stylus (or wire):

$$V_F = \frac{x}{t} \qquad \text{[Equation 8]}$$

or the time during which the mass moves at such constant velocity through a displacement x is:

$$t_{coast} = \frac{x\,m}{F_D\,t_p} \qquad \text{[Equation 9]}$$

Therefore, it can be appreciated that any relative increase in mass causes a relative change in the flight time. This, since the shuttle prints "on the fly", implies a similar relative change in dot position on the printed medium. A change in mass also changes the impact force ($F_I$) and the time duration of impact:

$$F_I = V_F \cdot \sqrt{m\,K_{is}} = F_D \cdot t_p \cdot \sqrt{\frac{K_{is}}{m}} \qquad \text{[Equation 10]}$$

with $K_{is}$ = Impact spring constant $$\left(\text{from } E_{KiN} = \frac{1}{2} mv^2 = E_{pot} = \frac{1}{2} \frac{F_I^2}{K_{is}}\right.$$

$$\left.\text{assuming an impact efficiency of 1}\right)$$

and the impact time $$t_I = \pi \sqrt{\frac{m}{K_{is}}}$$

(One half of the resonant cycle time of a spring-mass-system).

Accordingly, for all of these reasons, variations of mass between different print wires should be avoided. Equal mass of the print wires in spite of any differences in length is therefore provided in our invention.

For example, the front row of actuators 106 uses a short tungsten wire (=15 mm) while the back row actuators 108 are equipped with stainless steel tubes 1 containing an end slug 8 of tungsten wire brazed into place. The tube material is selected for lightweight, rigidity and manufacturability, while the end slug material should have superior wear characteristics.

By controlling the length of the print slug 8 in the print tube 1, the mass $M_L$ of each long wire actuator 104 may be adjusted to equal that of the short wire actuator $M_S$:

$$\frac{M_L}{M_S} = \frac{L_3}{L_1} + \frac{OD^2 - ID^2}{D^2} \frac{L_2\,\alpha}{L_1\,\beta} = 1$$

with

D=diameter of tungsten wire (=0.35 mm)

OD=outer diameter of stainless steel tube (=0.5 mm)

ID=inner diameter of stainless steel tube (=0.4 mm)

$\beta$=specific weight of tungsten ($=19.1\times10^{-3}$ g/mm$^3$)

$\alpha$=specific weight of steel ($=7.8\times10^{-3}$ g/mm$^3$)

$L_1$=length of the short wire (=15 mm)

$L_2$=length of the stainless steel tube (=35 mm)

$L_3$=length of tungsten slug at end of stainless steel tube (=4.5 mm).

The choice of parameters indicated above in parentheses substantially satisfy the above equation.

Some difference in dynamic behavior still remains in actuators of matched mass but different stylus length. The reason for this is that there will still be some difference in impact spring constant ($K_{is}$) due to the difference in print wire lengths. Although it is possible to correct for this difference by adding additional wire guides to the long wires, it is not typically needed. The combined spring constant of the stylus and the paper during impact are typically nearly the same for the short and long wires.

It will be appreciated that the use of different length but equal mass print wires may also find use in dot matrix printers of other than the "shuttle" type.

While the invention has been described with particular reference to the construction shown in the drawings, it is understood that further modifications may be made without departing from the true spirit and scope of the invention, which is defined by the claims appended hereto.

What is claimed is:

1. A dot matrix printer comprising:

an array of movable print wires comprising print wires of substantially diffeent lengths but all having substantially equal mass; and an array of electromagnetic print wire actuators, each actuator being disposed to electromechanically drive a respective one of said print wires;

wherein said array of print wires comprises a single linear array of equally spaced apart print wires, wherein said array of actuators comprises at least two linearly arrayed and mutually offset subsets of actuators with each such subset driving print wires having a common length but different from those driven by the other subset(s), and wherein at least the resulting longest length subset of print wires are each at least partially hollow.

2. A dot matrix printer as in claim 1 wherein each of said partially hollow print wires comprises a hollow stainless steel tube affixed to a solid tungsten carbide printing tip inserted within one end of said tube.

3. A dot matrix printer as in claim 2 wherein said array of actuators is mounted upon a shuttle carriage which is continuously and substantially sinusoidally oscillated along the direction of the print wire array with a peak-to-peak displacement substantially equal to the spacing between adjacent print wires.

4. A dot matrix printer as in claim 3 wherein the shortest length subset of print wires are constructed of solid tungsten carbide.

5. A dot matrix shuttle printing module, said module comprising:

a single linear and substantially planar array of equally spaced apart longitudinally movable substantially straight print wires terminating at their first ends in a common line of dot printing positions and having respective opposite second ends;

alternate ones of said print wires being of a first length shorter than the second longer length of the remaining ones of said print wires but all of said print wires having substantially equal respective masses;

a module base structure;

a first subset of linearly arrayed electromagnetic actuators affixed to said module base, and directly and drivingly supporting the second ends of said shorter print wires with a driving piston received within an electromagnetic coil; and a second subset of linearly arranged electromagnetic actuators disposed in parallel offset relationship to said first subset of actuators, said second subset of actuators also being affixed to said module base, and directly and drivingly supporting the second ends of said longer wires with a driving piston received within an electromagnetic coil.

6. A dot matrix shuttle printing module as in claim 5 wherein each of said actuators has a minimum outside dimension greater than the center-to-center spacing between adjacent print wires.

7. A dot matrix shuttle printing module as in claim 6 wherein said longer print wires are at least partially hollow.

8. A dot matrix shuttle printing module as in claim 7 wherein each of said longer print wires comprise:

a hollow steel tube; and a solid dot-printing tip affixed to one end of said hollow steel tube.

9. A dot matrix shuttle printing module as in claim 8 wherein said shorter printer wires each comprise a unitary solid wire having a dot-printing tip at one of its ends.

10. A dot matrix shuttle printer module, said module comprising:

a module base structure;

an array of electromagnetic piston actuators received within an electromagnetic coil which is affixed to said module base;

said array being composed of a plurality of subsets, the actuators in one subset being offset from and parallel to the actuators in another of said subsets; and a linear array of longitudinally movable substantially straight print wires having substantially different lengths but substantially equal masses, each print wire having one end drivingly aligned with a respective one of said piston actuators and having all opposite ends of the print wires terminated in a common line of dot-printing positions.

11. A dot matrix shuttle printer module as in claim 10 wherein the print wires comprise at least two subsets, with each subset having substantially equal lengths therewithin and wherein the print wires in at least the subset having the longest lengths are at least partially hollow.

12. A dot matrix shuttle printer module as in claim 11 wherein said at least partially hollow print wires comprise:

a hollow steel tube; and a solid dot-printing tip affixed to one end of said hollow steel tube.

13. A dot matrix shuttle printer module as in claim 12 wherein the shortest subset of print wires each comprises a unitary solid wire having a dot-printing tip at one of its ends.

* * * * *